US006962506B1

(12) United States Patent
Krobusek

(10) Patent No.: US 6,962,506 B1
(45) Date of Patent: Nov. 8, 2005

(54) ELECTRICAL COUPLING DEVICE FOR USE WITH AN ELECTRICAL POWER CONVERTER

(76) Inventor: Richard D. Krobusek, 4109 Kirkwall St., Plano, TX (US) 75093-2611

( * ) Notice: Subject to any disclaimer, the term of this patent is extended or adjusted under 35 U.S.C. 154(b) by 980 days.

(21) Appl. No.: 09/649,358

(22) Filed: Aug. 28, 2000

Related U.S. Application Data

(63) Continuation-in-part of application No. 09/167,907, filed on Oct. 7, 1998, now abandoned.

(51) Int. Cl.[7] ..... H01R 11/00
(52) U.S. Cl. ..... 439/502; 439/650
(58) Field of Search ..... 439/502, 501, 439/369, 373, 507, 509, 512, 513, 445, 447, 650, 651, 652; D13/142

(56) References Cited

U.S. PATENT DOCUMENTS

| | | | | |
|---|---|---|---|---|
| 5,320,560 A | | 6/1994 | Fladung | 439/490 |
| 5,454,729 A | * | 10/1995 | Wen-Te | 439/357 |
| 5,466,172 A | | 11/1995 | Carstens et al. | 439/502 |
| D384,329 S | * | 9/1997 | Kammersgard et al. | D13/146 |
| 5,848,915 A | * | 12/1998 | Canizales | 439/650 |
| 5,904,591 A | | 5/1999 | Shiau | 439/502 |

OTHER PUBLICATIONS

Tools & Gadgets: Liberator Cords; http:/www.herrington-catalog.com/t748.html; Mar. 11, 2003.

* cited by examiner

*Primary Examiner*—Alexander Gillman

(57) ABSTRACT

The present invention provides an electrical coupling device for use with an electrical device. In one embodiment, the electrical coupling device comprises: (1) a cable having multiple insulated conductors, a centerline, and first and second ends, (2) a first electrical connector having a first longitudinal axis coincident with the centerline wherein the first electrical connector is coupled to the first end and the first electrical connector is couplable to a power outlet, (3) a second electrical connector having a second longitudinal axis coincident with the centerline wherein the second electrical connector is coupled to the second end and the second electrical connector is couplable to an electrical device, and (4) a strain relief structure substantially surrounding the cable and having a length that extends from the first electrical connector to the second electrical connector and a flexibility along its length, with the strain relief structure further coupled to the first and second electrical connectors, and wherein the flexibility is capable of allowing the centerline to resiliently flex such that the second longitudinal axis may deviate at least about 90 degrees from the first longitudinal axis.

21 Claims, 8 Drawing Sheets

ELECTRICAL COUPLING DEVICE FOR USE WITH AN ELECTRICAL POWER CONVERTER

CROSS-REFERENCE TO RELATED APPLICATION

This application is a continuation in part of U.S. patent application Ser. No. 09/167,907, filed on Oct. 7, 1998 now abandoned, and currently pending, entitled "Electrical Coupling Device for Use with an Electrical Power Converter" to Krobusek which is incorporated herein by reference.

TECHNICAL FIELD OF THE INVENTION

The present invention is directed, in general, to an electrical coupling device and, more specifically, to an electrical coupling device for use with electrical power converters.

BACKGROUND OF THE INVENTION

Referring initially to FIG. 1A, illustrated is a plan view of a conventional power strip with first and second power converters plugged into selected outlets. A conventional power strip 100 comprises a male three-prong electrical plug 110, a power cord 120, a receptacle housing 130, and a plurality of female electrical receptacles, generally designated 140 and individually designated 140*a*–140*f*. The conventional power strip may also comprise an on/off switch 143 and a circuit breaker/reset button 144. While the number of female electrical receptacles 140 may vary from as few as two or three to perhaps as many as eight, a large percentage of available power strips 100 generally have six receptacles 140. The receptacles 140 have an inter-receptacle spacing 145. With respect to the inter-receptacle spacing 145, the illustrated power strip 100 is representative of standard duplex wall outlets, most outlet multipliers, and many power strips, power centers and uninterruptable power systems commonly in use with personal computers, telephone systems, high-fidelity and television systems, home and commercial satellite receiver systems, etc. These electrical devices are generally sized with about a 1½" edge-to-edge spacing 145. Although the illustrated embodiment is of a "ground-down" configuration with respect to the power cord 120, a "ground-up" configuration may also be found. Also, the illustrated embodiment is that of a 3-conductor grounded system; two wire systems including polarized outlets 140 and plugs 110 may also be found.

Two power converters 150, 160 are shown installed in outlets 140*a* and 140*f* respectively. Although power converters generally vary considerably in size from application to application, i.e., cordless telephone, scanner, battery charger, cellular phone charger, external disk drive, external speakers, etc., most are large enough to block at least one adjacent outlet 140 of a power strip 100. The power converters 150, 160 shown represent the estimated size extremes of a sample of commercially available power converters used with appliances such as listed above.

When only a few devices are plugged into the power strip 100, e.g., only two are shown in FIG. 1A, the loss of one or two outlets 140 due to blockage by an adjacent power converter 150, 160 is not usually a problem. However, as most personal computer users know, the number of devices requiring electrical power at a personal computer installation generally increases over time and, therefore, unusable outlets, for example in FIG. 1A outlets 140*b*, 140*c* and 140*e*, become a problem of wasted resources. One who is skilled in the art will readily observe that the power converter 150 itself obstructs outlet 140*b* and its secondary power lead 155 effectively obstructs outlet 140*c* when installed as shown. This location might be necessary if the power converter 150 is equipped with a grounded or polarized plug. When the converter 150 incorporates a polarized or grounded plug, the converter 150 may only be installed in one direction, thus limiting the location of the converter 150 installation to only one or two outlet choices. Clearly, it is recognized that if power converter 150 is the only converter required at that power strip 100 location, one who is of ordinary skill in the art would certainly install power converter 150 in outlet 140*f*, thereby making the other five of the six outlets useable for other devices employing conventional male three-prong plugs. However, for the sake of this discussion it is assumed that two polarized-plug power converters 150, 160 are required at this location. Thus, the illustrated installation is the least restrictive and most logical in that this installation minimizes the blocked outlets to outlets 140*b*, 140*c* and possibly 140*e*. In this configuration, the size of power converter 160 makes it very difficult to use outlet 140*e* with a grounded plug. With some converters, because of prong placement or a polarized ground, the location of its secondary power lead 165 may cause outlet 140*e* to be unuseable. Therefore, the available outlets 140*a*–140*f* may be reduced from six to only three useable outlets 140*a*, 140*d*, and 140*f*. Thus, in this illustration, the available outlets 140 of the power strip 100 are reduced by 50 percent. Of course, if at least one electrical device required at this power strip location has only a two-bladed plug, then outlet 140*e* may also be used.

Referring now to FIG. 1B with continuing reference to FIG. 1A, illustrated is a plan view of an alternative embodiment 101 of the conventional power strip of FIG. 1A. In this embodiment, a conventional power strip 101 comprises outlets 141*a*–141*f* that are in the same locations as the outlets 140*a*–140*f* of FIG. 1. However, the outlets 141*a*–141*f* of FIG. 1B are rotated 90° so that they are in a side-by-side configuration. Inter-receptacle spacing 147 is as close as 1 1/16" between adjacent outlets, here collectively designated 141. The designs of FIGS. 1A and 1B adequately accommodate a plurality of typical male electrical grounded plugs, similar to the male electrical plug 110, for several appliances required at a single location. As in FIG. 1A, power converters 150, 160 are installed in outlets 141*a* and 141*f*, respectively. A common ground orientation, as shown, for the outlets 141 is usually maintained by manufacturers. In this embodiment, the consequences will be the same with both polarized and non-polarized plugs on the converters 150, 160, i.e., outlets 141*b* and 141*e* will be blocked. While power converter 160 might be installed in outlet 141*d* so that both converters 150, 160 block a common outlet 141*e*, the effect will be the same—only four useable outlets 141*a*, 141*b*, 141*d*, 141*f* from the original six outlets of the power strip.

It should be noted that other configurations for multiple power outlets are also available on the market. For instance, instead of six outlets 140 in a row as in FIGS. 1A and 1B, outlet configurations also exist of two rows of three outlets each. However, these configurations suffer from the same problems and limitations as detailed above and may, in some instances, have more significant problems for the same reasons.

Traditional solutions to these problems include installing: (a) a different power strip with more outlets, (b) an additional power strip either connected to the wall outlet or to one of the original power strip outlets, or (c) an extension cord with additional outlets. These solutions present four major problems. First, a power strip with more outlets may have outlets that are not really required, clearly at an additional cost over that of the original power strip. Second, a second power strip is additional clutter to what is probably already a nest of cables. The additional power strip may have a significant number of unused outlets or, if plugged into an outlet of the original power strip, might encourage overloading the original power strip or power circuit with an excessive number of appliances. Third, the extra six to ten feet of extension cord is also additional clutter. Fourth, ordinary extension cords for permanent wiring solutions are strongly discouraged by fire and safety experts alike because of the increased fire risk and tripping hazard.

Only recently have power strip and power center manufacturers recognized the problems detailed above and begun to offer solutions. Referring now to FIG. 1C, illustrated is a plan view of a second alternative embodiment 102 of the conventional power strip of FIG. 1A. In this embodiment, the power strip 102 comprises the male three-prong electrical plug 110, power cord 120, a receptacle housing 132, and a plurality of female electrical receptacles, generally designated 142 and individually designated 142*a*–142*f*. The approach in this prior art embodiment has been to increase spacing between some of the outlets 142 to allow insertion of power converters 150, 160. Four of the receptacles 142*a*–142*d* have a conventional inter-receptacle spacing 145, while receptacles 142*e* and 142*f* have a greater inter-receptacle spacing 148 and are separated from the other receptacles 142*a*–142*d* by a significant distance 146 that permits better use of all outlets 142. However, the number of spaced-apart outlets, e.g., 142*e*, 142*f*, is usually limited to about one-third of the total outlets 142 of a power strip 102 or power center. Therefore, if the number of power converters needed at a single location exceed the number of spaced-apart receptacles 142*e*, 142*f* provided on the power strip 102, the problems detailed above remain. Various configurations employing this solution may be currently found on the market.

Accordingly, what is needed in the art is a device that (a) eliminates the outlet blocking problem of power converters, (b) eliminates unnecessary extension cord lengths, (c) is usable with all power strips, receptacles, power centers, etc., and (d) is cost effective.

SUMMARY OF THE INVENTION

To address the above-discussed deficiencies of the prior art, the present invention provides an electrical coupling device for use with an electrical device. In one embodiment, the electrical coupling device comprises: (1) a cable having multiple insulated conductors, a centerline, and first and second ends, (2) a first electrical connector having a first longitudinal axis coincident with the centerline wherein the first electrical connector is coupled to the first end and the first electrical connector is couplable to a power outlet, (3) a second electrical connector having a second longitudinal axis coincident with the centerline wherein the second electrical connector is coupled to the second end and the second electrical connector is couplable to an electrical device, and (4) a strain relief structure substantially surrounding the cable and having a length that extends from the first electrical connector to the second electrical connector and a flexibility along its length, with the strain relief structure further coupled to the first and second electrical connectors, and wherein the flexibility is capable of allowing the centerline to resiliently flex such that the second longitudinal axis may deviate at least about 90 degrees from the first longitudinal axis.

Thus, in a broad sense, the present invention provides an electrical coupling device having a flexible strain relief structure that is independent of individual conductor insulation jackets and that substantially surrounds the electrical conductors. The flexible strain relief structure extends between and couples to both the first and second electrical connectors. The electrical coupling device is intended to couple between an electrical device and a power source. The power source may be any of a duplex outlet, a power strip, a power center or, especially any electrical power outlet configuration wherein adjacent outlets are so closely spaced as to be blocked by direct insertion of an electrical device other than a male electrical plug. The electrical coupling device allows flexibly coupling the electrical device to the power source with a resilient flexibility of at least about 90 degrees of flex from the first longitudinal axis in any direction, i.e., 360 degrees about the first longitudinal axis. Therefore, the power converter may be located in such a way as to allow easy access to adjacent outlets for additional male electrical plugs.

In another embodiment, the flexibility is capable of allowing the centerline to flex such that the second longitudinal axis may deviate at most about 140 degrees from the first longitudinal axis in any of 360 degrees about the first longitudinal axis. In an especially advantageous embodiment, the electrical device is an electrical power converter. In another advantageous embodiment, the first and second electrical connectors, as well as the strain relief structure, are integrally formed with the first and second ends being contained within the first and second electrical connectors, respectively. The electrical coupling device, in an alternative embodiment, further comprises an insulation layer surrounding the cable and the strain relief structure substantially surrounds the insulation layer.

In an alternative embodiment, the cable is a multi-conductor electrical cable of a gauge sufficient to carry 110 volts AC electricity between the first and second electrical connectors.

The first electrical connector, in another embodiment, may be a polarized male electrical plug, while the second electrical connector may be a polarized female electrical receptacle. The first electrical connector, in yet another embodiment, is a three-conductor male plug and the second electrical connector is a three-conductor female receptacle.

In another advantageous embodiment, the cable comprises first, second, and third electrical conductors wherein: (a) the first electrical conductor is couplable to a system line conductor of the power outlet, (b) the second electrical conductor is couplable to a system common conductor of the power outlet, and (c) the third electrical conductor is couplable to a system ground of the power outlet.

Another embodiment further comprises a boss coupled to the second electrical connector wherein the boss is configured to couple to a security band disposed about the electrical device. In a further aspect of this embodiment, the second electrical connector has a connector face normal the second longitudinal axis and the boss has a concave surface opposite the connector face with the concave surface configured to receive the security band. In an advantageous embodiment to be illustrated and described, the length of the strain relief is less than about two inches.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 2A:
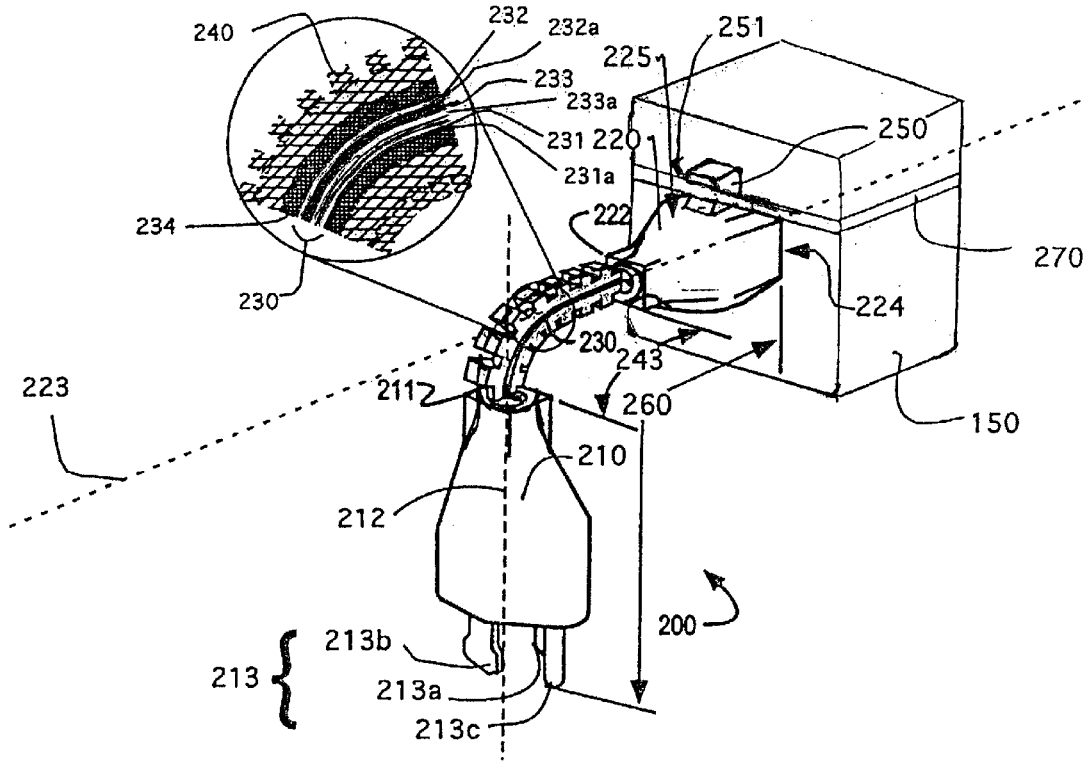
FIG. 2A illustrates a partial cutaway view of one embodiment of an electrical coupling device constructed according to the principles of the present invention.

Referring now to FIG. 2A, illustrated is a partial cutaway view of one embodiment of an electrical coupling device 200 constructed according to the principles of the present invention. The electrical coupling device 200 comprises a first electrical connector 210, a second electrical connector 220, an electrical cable 230, a flexible strain relief structure 240, and a boss 250. In the illustrated embodiment, the cable 230 is a multi-conductor electrical cable 230 comprising three conductors 231, 232, 233 wherein each conductor has its own insulation jacket 231*a*, 232*a*, 233*a*, respectively. Another insulation layer 234 surrounds the three conductors 231, 232, 233 and their insulation jackets 231*a*, 232*a*, 233*a*. In a particularly advantageous embodiment, the strain relief structure 240 substantially surrounds the insulation layer 234 of the electrical cable 230. In another aspect, the strain relief structure 240 extends from the first electrical connector 210 to the second electrical connector 220 and has a length 243. In a preferred embodiment, the length 243 is less than about two inches and the strain relief structure is flexible along its entire length 243.

Furthermore, the multi-conductor electrical cable 230 has first and second ends 211, 222, respectively. In a preferred embodiment, the first electrical connector 210 has a first longitudinal axis 212 and may be a polarized, male electrical plug 210 that is coupled to the first end 211 of the multi-conductor electrical cable 230. The second electrical connector 220 has a second longitudinal axis 223 and may be a polarized, female electrical receptacle that is coupled to the second end 222. In the specific embodiment shown, the polarized male electrical plug 210 is a three-conductor grounded male plug 210 and the polarized female electrical receptacle 220 is a single three-conductor grounded female receptacle 220.

Individually, the three conductors 231, 232, 233 of the multi-conductor electrical cable 230 are electrically coupled to male prongs/blades 213*a*, 213*b*, 213*c* (collectively designated 213) of the first electrical connector 210 and to corresponding female contacts (not shown) of the second electrical connector 220. Specifically, the first electrical conductor 231 is couplable to a system line, or "hot" conductor of a power outlet (not shown) by system blade 213*a*, while the second electrical conductor 232 is couplable to a system common or "neutral" conductor of the power outlet through neutral blade 213*b*, and the third electrical conductor 233 is couplable to system ground of the power outlet through ground prong 213*c*. One who is skilled in the art is familiar with three-conductor male plugs and three-conductor female receptacles and their wiring. It should be observed that the system blade 213*a* and neutral blade 213*b*, in and of themselves, together constitute polarized blades constructed in such a manner as to prevent incorrect insertion into a polarized outlet (not shown). One who is skilled in the art is familiar with such polarized outlets and plugs.

In one advantageous embodiment, the first and second ends 211, 222 are contained within the first and second electrical connectors 210, 220, respectively, that are formed as rigid bodies. The multi-conductor cable 230 has a centerline 233 that is coincident with the first and second longitudinal axes 212, 223, respectively. The three electrical conductors 231, 232, 233 are of a wire gauge sufficient to carry commercial 110 volt AC electricity and have an ampacity suitable for coupling to a conventional duplex outlet, i.e., at least about 30 amperes. Ampacity is herein defined as the capacity of a circuit or component to safely carry a prescribed number of amperes of electricity for a prescribed voltage. Located radially about the multi-conductor electrical cable 230 and extending from the first electrical connector 210 to the second electrical connector 220 is the strain relief structure 240 that has resilient flexibility along its length 243.

The flexible strain relief structure 240 is capable of allowing the cable centerline 233 to resiliently flex such that the second longitudinal axis 223 may deviate at least about 90 degrees, as shown, from the first longitudinal axis 212 in any direction, i.e., 360 degrees, about the first longitudinal axis 212. For the purpose of this discussion, resilient flexibility is that property that allows the electrical coupling device 200 to be bent along the cable centerline 233 while the second electrical connector 220 tends to return so that the first and second longitudinal axes 212, 223 are aligned. However, resilient flexibility allows the second electrical connector 220 to remain at least partially displaced from a co-alignment condition of axes 212, 223 when the second electrical connector 220 is coupled to a power converter 150. This property allows the second electrical connector 220 to be conveniently displaced in any of 360 degrees about the first longitudinal axis 212 for inserting a second electrical plug in an adjacent outlet, yet resist the weight of the power converter 150. While the present discussion is directed to use of the electrical coupling device 200 with a power converter 150, it should be clear to anyone who is skilled in the art that the present invention is also useable with any electrical device that may receive electrical power from a power outlet via a male electrical plug. For example, many home appliances, such as: freezers, refrigerators, table-top microwaves, etc., are today supplied with a flat male electrical plug that is intended to lay flat against the wall when plugged into an outlet, the wire hanging vertically from the plug and built-in strain relief thereby relieving strain on the wire entering the plug. These flat plugs are almost invariably of the three-prong grounded type and therefore only fit into an outlet in one direction. Meanwhile, there is no standard in the United States as to whether the duplex outlet must be installed ground-up or ground-down in the wall box. Therefore, the outlet may be installed in either orientation depending upon the whim of the electrician while still meeting code requirements. As most homeowners are loathe to open a wall outlet box and re-orient the duplex outlet, this orientation may require the owner to install the flat plug in an inverted position to that intended by the appliance designer; thereby folding the wire over and defeating the very purpose of the flat plug. Installing the electrical coupling device 200 of the present invention in the outlet and coupling the appliance to the electrical coupling device 200 more correctly distributes the hanging wire load to the strain relief of the electrical coupling device 200 and relaxes the wire-to-plug junction of the appliance. Of course, one who is skilled in the art will readily find other useful applications for the present invention.

The boss 250 is coupled to the second electrical connector 220 so as to provide a coupling point for a security band 270 disposed about an electrical device, that in the present instance is the power converter 150. The security band 270 may be an extensible band such as a common rubber band, or any other suitable banding device such as a cable tie, plastic bundle tie, twist tie, etc. In a preferred embodiment, the second electrical connector 220 has a connector face 224 normal the second longitudinal axis 223 and the boss 250 has a concave surface 251 opposite the connector face 224. The concave surface 251 is configured to receive and more securely hold the security band 270, thereby preventing the power converter 150 from separating from the second electrical connector 220. Of course, while the boss 250 provides the advantages described above, the electrical coupling device 200 may also be constructed without a boss 250 while still remaining within the broadest scope of the present invention. While the boss 250 is shown on one surface 225, it may be located on any of the exposed surfaces of the second electrical connector 220 as desired.

Figure 2B:
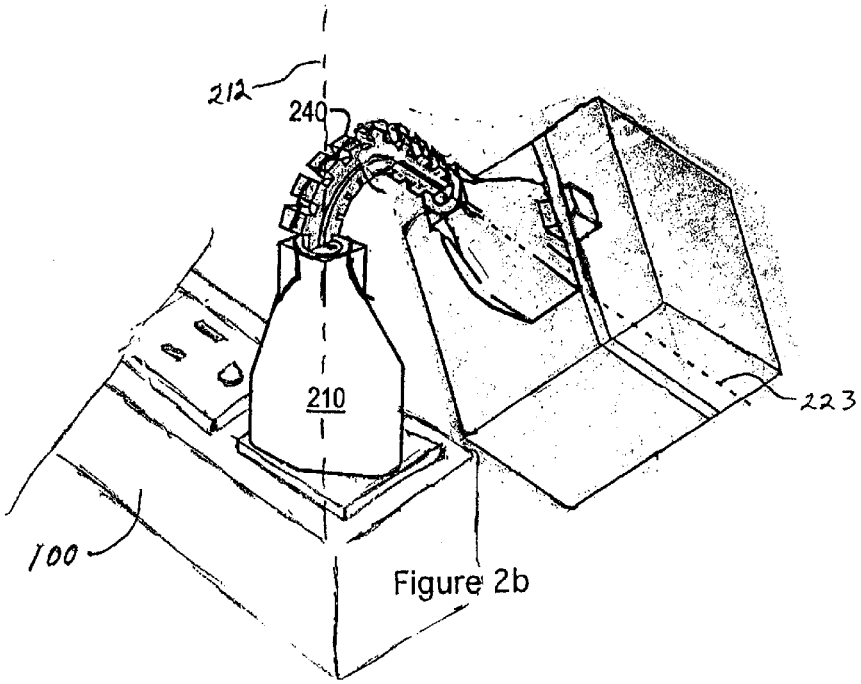
FIG. 2B illustrates an isometric view of the electrical coupling device of FIG. 2A when installed in a conventional power strip and coupled to an electrical device.

Referring now to FIG. 2B, illustrated is an isometric view of the electrical coupling device 200 of FIG. 2A when installed in a conventional power strip 100 and coupled to an electrical device 150. In this particularly advantageous embodiment, the electrical device is an electrical power converter 150. As shown in FIG. 2B, it has been found that the weight of the power converter 150 causes the resilient flexibility of the strain relief structure 240 to bend to a maximum of about 140 degrees, when not otherwise restricted, while keeping the power converter 150 in proximity to the power strip 100.

Referring now simultaneously to FIGS. 2A and 2B, one who is skilled in the art will recognize that the first electrical connector 210 is coupleable to a conventional 110 volt AC power source and that the second electrical connector 220 is coupleable to a conventional 110 volt AC load. In the advantageous embodiment shown, the 110 volt AC load is an electrical power converter 150 and the electrical power source is an electrical power strip 100. In a preferred embodiment, the length 243 of the strain relief structure 240 is less than about two inches. It has been found that when the length 243 of the strain relief structure 240 is less than about two inches, an overall length 260 of the electrical coupling device ranging from about five inches to six inches is achieved. When coupled with resilient flexibility built into the material of the strain relief structure 240, this overall length 260 allows most power converters 150 to conveniently rest on a surface adjacent to a power strip 100.

The strain relief structure 240 stiffens the electrical cable 230 and limits movement of the power converter 150 attached to the second electrical connector 220. Although somewhat stiff when not in use, the multi-conductor cable 230 and strain relief structure 240 are sufficiently flexible to allow the second electrical connector 220 to be positioned so as to avoid blocking adjacent receptacles 140 when installed in the power strip 100, a duplex outlet, or a power center (not shown). While keeping the second electrical connector 220 in close proximity to the first electrical connector 210, this strain relief structure 240 permits limited flexibility of the electrical coupling device 200 while additionally preventing separation of either the three-prong male plug 210 or the female receptacle 220 from the three-conductor cable 230. It should be noted that the strain relief structure 240 is much more than a conventional electrical cable outer insulation layer, such as insulation layer 234 that is designed as insulation, i.e., electrical shock protection, and to bundle the conductors together. The strain relief structure 240 is not intended as a handle for insertion into or removal from a power outlet. One who is skilled in the art is familiar with the design and function of strain reliefs as they are distinguished from cable insulation.

It should be noted that while a three-conductor electrical coupling device has been described thus far, the principles of the present invention are equally adaptable to a two-conductor electrical coupling device having polarized first and second electrical connectors as described above and employing double insulation in lieu of a ground conductor as permitted by applicable electrical codes.

Figure 3A:
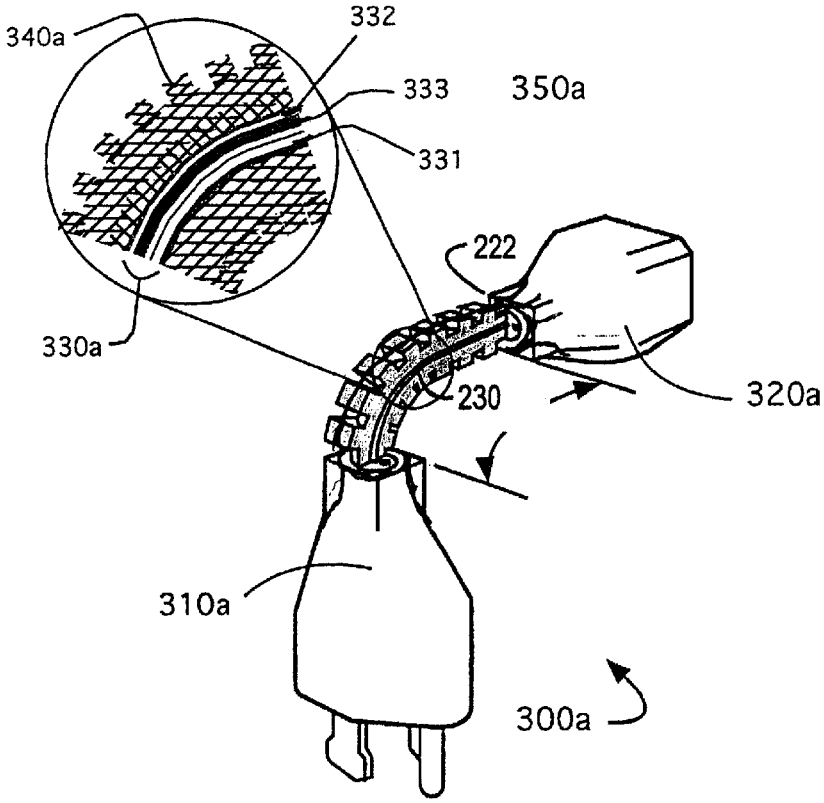
FIG. 3A illustrates a partial cutaway view of an alternative embodiment of the electrical coupling device of FIG. 2.
Figure 3B:
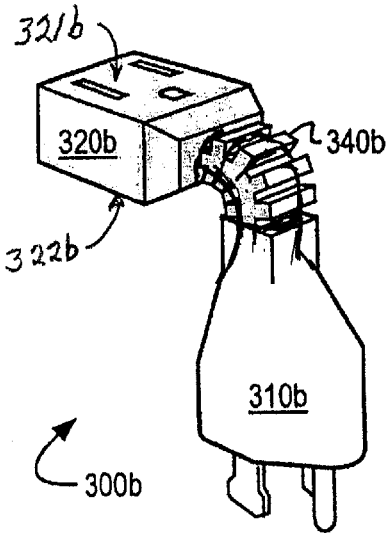
FIG. 3B illustrates a second alternative embodiment of the electrical coupling device of FIG. 2.

Referring now to FIGS. 3A and 3B, illustrated are two alternative embodiments of the electrical coupling device of FIG. 2. In the embodiment of FIG. 3A, a partial cutaway view of an alternative embodiment 300*a* of the electrical coupling device 200 of FIG. 2 is shown. The electrical coupling device 300*a* comprises a three-prong male plug 310*a*, a three-conductor female receptacle 320*a*, three electrical conductors 331, 332, 333, that may be considered a three-conductor cable 330*a*, a strain relief structure 340*a*, and a boss 350*a*. The electrical coupling device 300*a* is generally constructed in a manner similar to the electrical coupling device 200 of FIG. 2. However, the strain relief feature 340*a* of this embodiment extends from the three-prong male plug 310*a* to the three-conductor female receptacle 320*a* and is formed directly about the three electrical conductors 331, 332, 333 without the cable insulation layer 234 of FIG. 2A. In the illustrated embodiment, the three-prong male plug 310*a*, strain relief structure 340*a* and three-conductor female receptacle 320*a*, may be molded about the three-conductor cable 330*a* during a single process. The electrical coupling device 300*a* provides more flexibility in the positioning of the three-conductor female receptacle 320*a* than that of the electrical coupling device 200 of FIG. 2A.

In the embodiment of FIG. 3B, an electrical coupling device 300*b* comprises a first electrical connector (three-prong male plug) 310*b*, a second electrical connector (three-conductor female receptacle) 320*b*, a three-conductor cable (not visible, but designated 330*b*), and a strain relief structure 340*b*. In this embodiment, the three-conductor cable within the strain relief 340*b* may be essentially flat, enabling the second electrical connector 320*b* to be folded back over to one side of the first electrical connector 310*b*. In this advantageous embodiment, the second electrical connector 320*b* may comprise two female electrical receptacles, one of which is shown as 321*b* and the other of which is indicated (but not visible) as 322*b*. One who is skilled in the art will readily conceive of other variations that may be used to provide specific advantages while remaining within the greatest scope of the present invention.

Figure 1A:
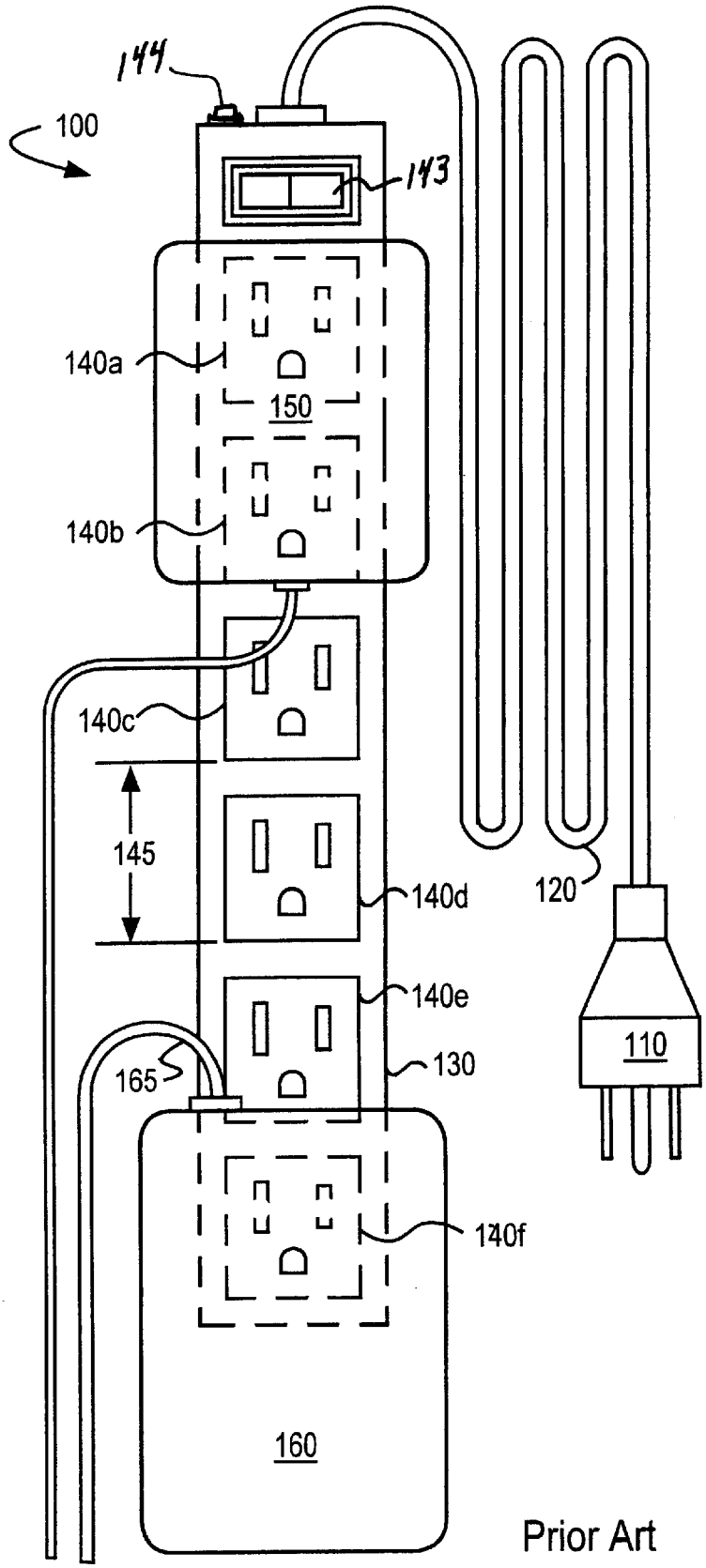
Prior Art Figure 1a
FIG. 1A illustrates a plan view of a conventional power strip with first and second power converters plugged into selected outlets.
Figure 1B:
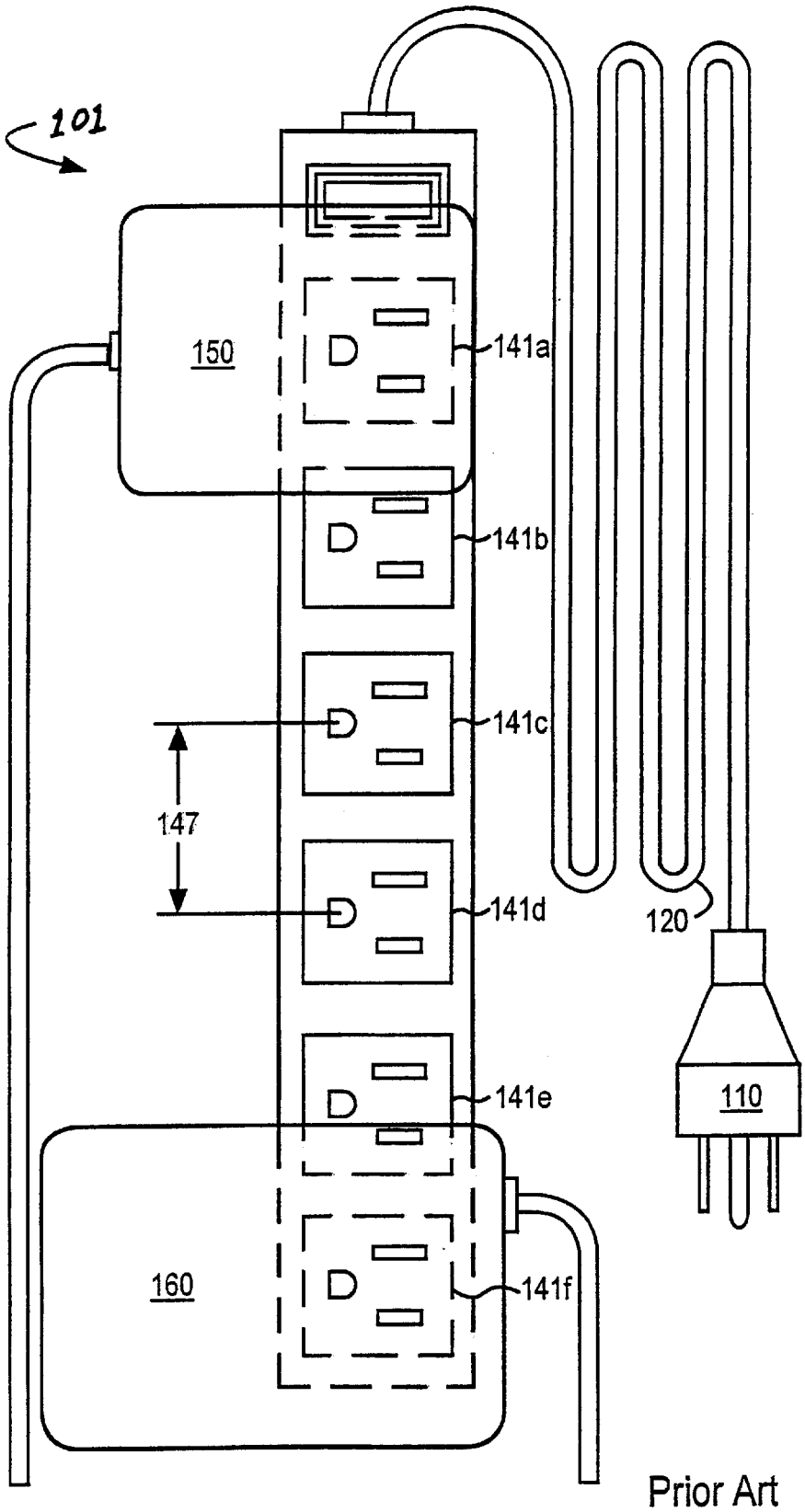
FIG. 1B illustrates a plan view of an alternative embodiment of the conventional power strip of FIG. 1A.
Figure 1C:
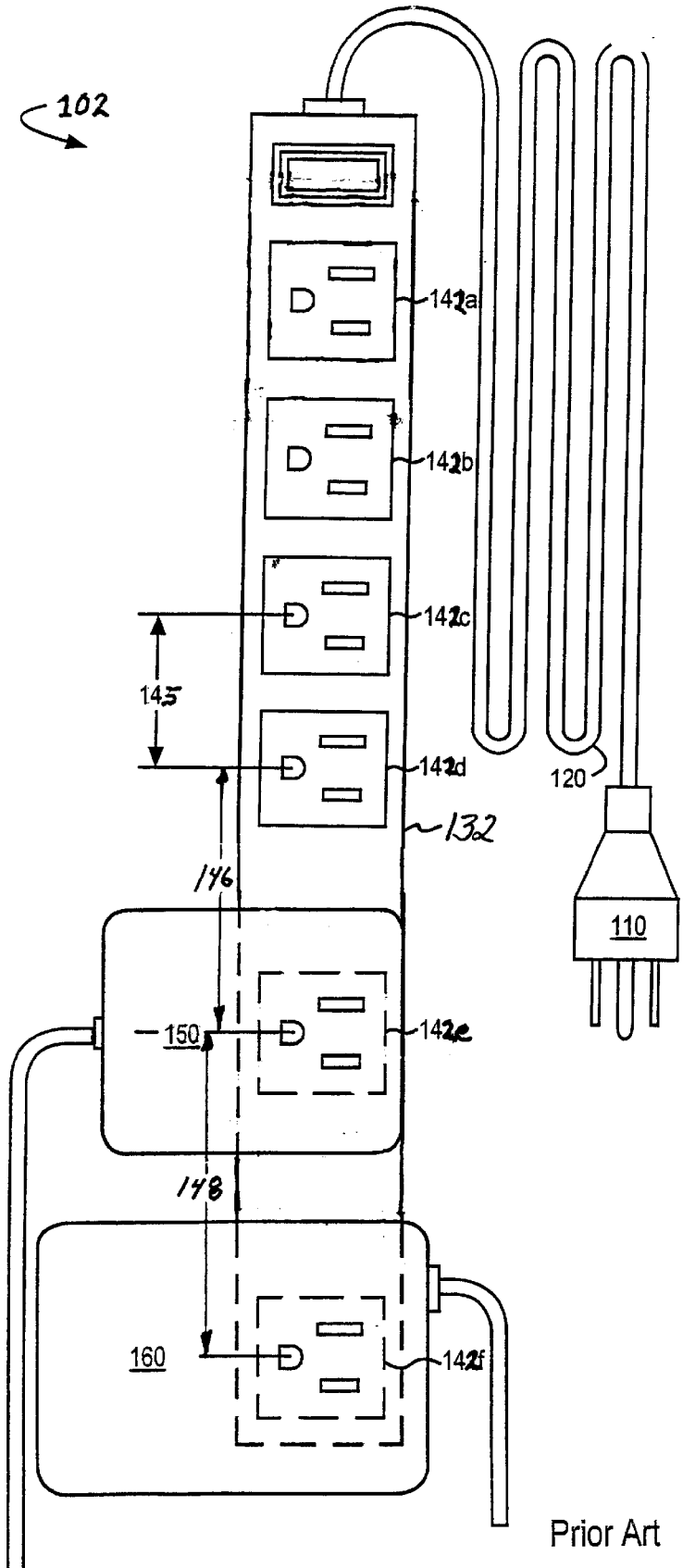
Prior Art Figure 1c
FIG. 1C illustrates a plan view of a second alternative embodiment of the conventional power strip of FIG. 1A.
Figure 4:
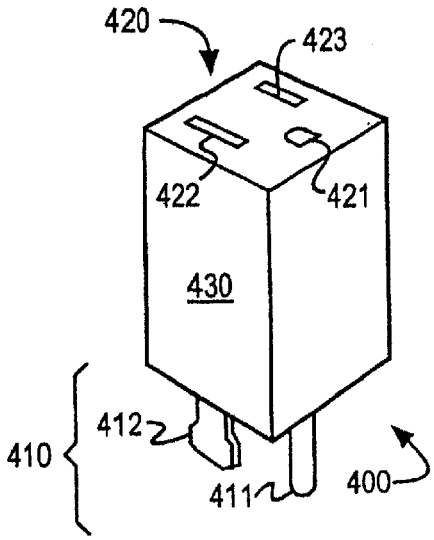
FIG. 4 illustrates a third alternative embodiment of an electrical coupling device constructed according to the principles of the present invention.

Referring now to FIG. 4 with continuing reference to FIG. 1A, illustrated is an alternative embodiment of an electrical coupling device constructed according to the principles of the present invention. In this embodiment, an electrical coupling device 400 comprises a male plug 410, a female receptacle 420, and a plug body 430. Conductors (not visible) of the male plug 410 are electrically coupled to corresponding conductors 421, 422, 423 of the female receptacle 420 within the plug body 430. When installed in a power strip 100, the female receptacle 420 is sufficiently distant from the male plug 410 to allow access to adjacent receptacles 140*a*–140*f*by other electrical plugs. This embodiment is especially useful in situations where it is necessary to shorten the electrical coupling device to an absolute minimum.

Figure 5:
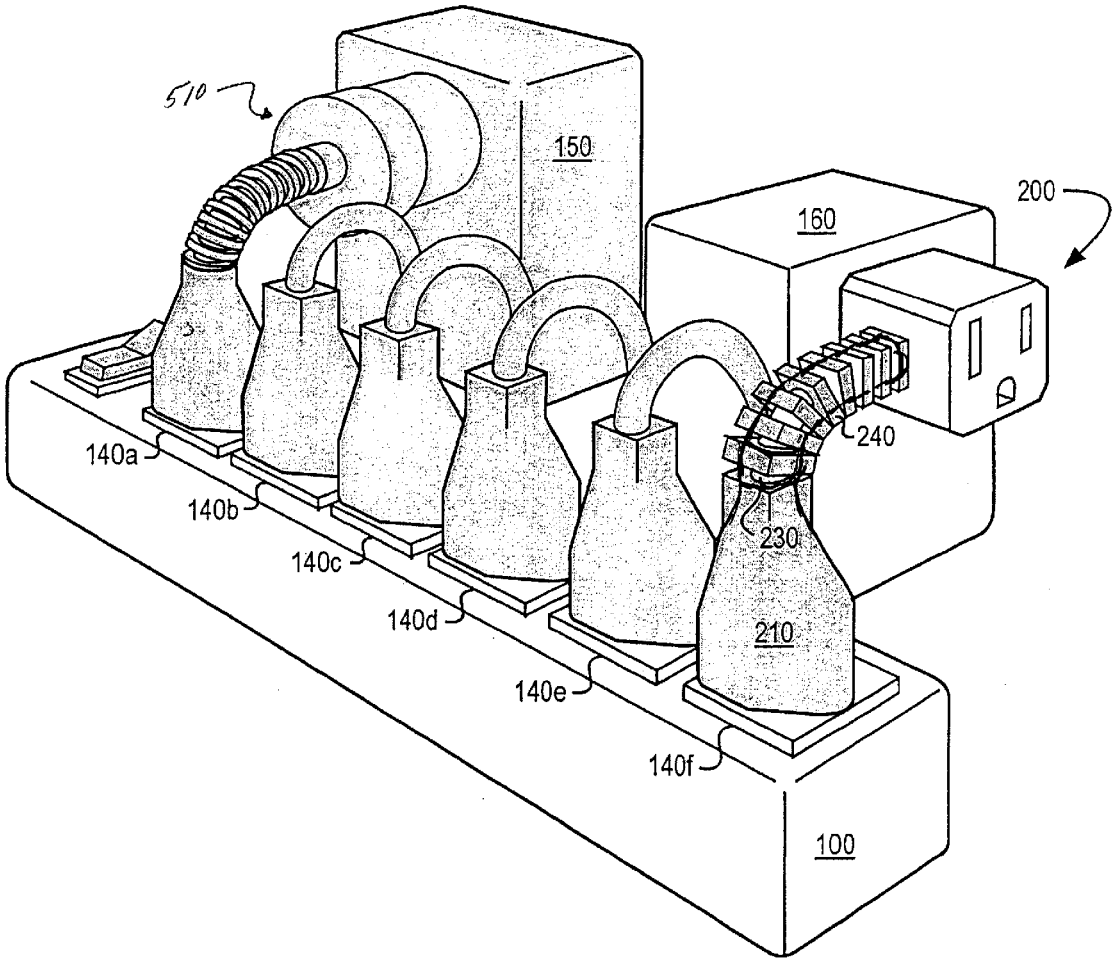
FIG. 5 illustrates the conventional power strip of FIG. 1A with two embodiments of the electrical coupling devices of FIGS. 2A installed.

Referring now to FIG. 5 with continuing reference to FIG. 2A, illustrated is the conventional power strip of FIG. 1A with two embodiments of the electrical coupling devices of FIG. 2A installed. One three-prong male plug 210 couples physically and electrically with each of outlets 140*a* and 140*f* of the power strip 100. Likewise, power converters 150, 160 couple physically and electrically with the three-conductor female receptacles (not visible) of the electrical coupling devices 510, 200, respectively. As can be seen, the electrical coupling devices 510, 200 allow power converters 150, 160 to remain clear of adjacent outlets 140*b* and 140*e*, freeing the outlets 140*b*, 140*e* for use by other electrical devices (not shown). The flexible nature of the multi-conductor cable 230 and strain relief structure 240 allows cable 230 to flex from normal to the power strip 100 so that the power converters 150, 160 may lay alongside the power strip 100 as necessary. The shortness of the three-conductor cable 230 eliminates unnecessary cable and the tripping hazard associated with conventional extension cords of six feet to ten feet in length. Additionally, the cost of the electrical coupling devices 200, 510 is significantly less than the cost of a second power strip 100.

Figure 6A:
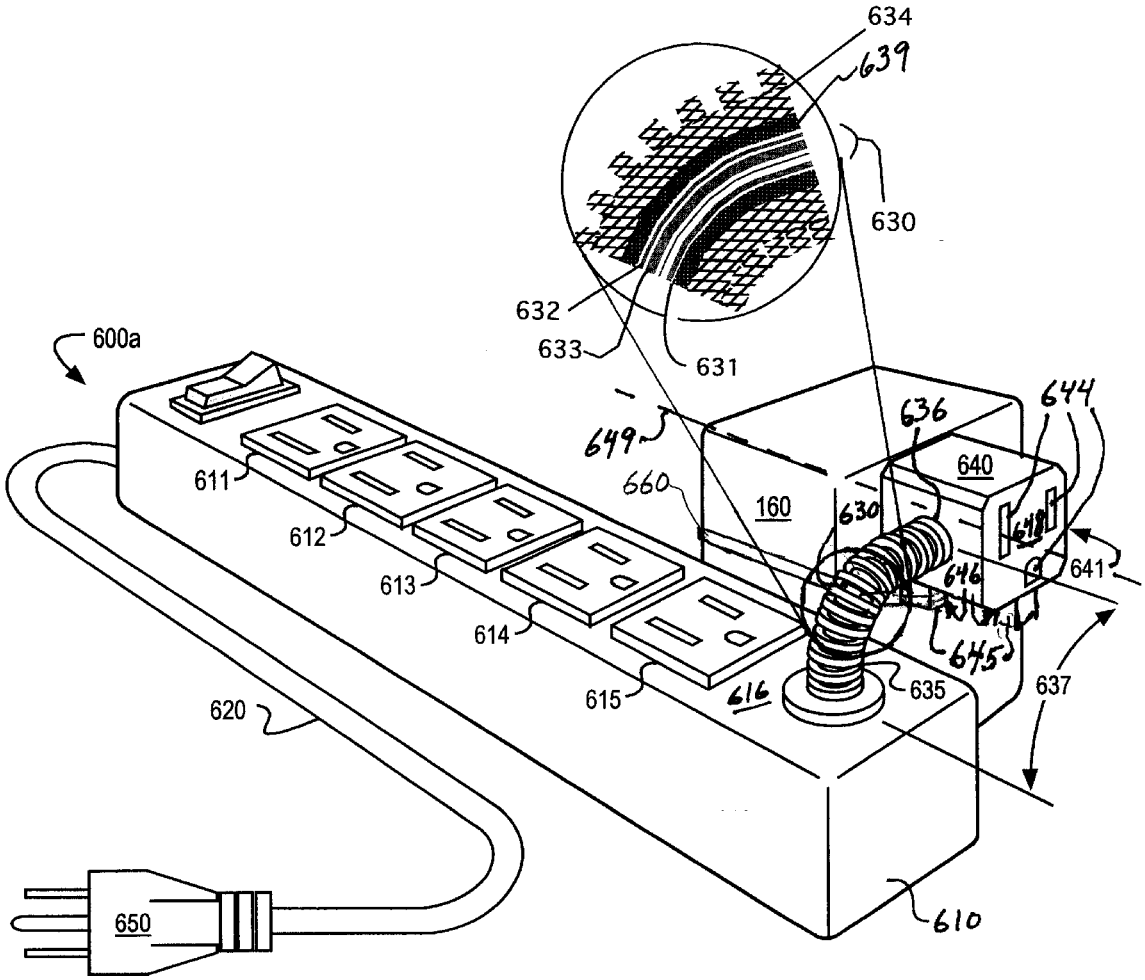
FIG. 6 illustrates one embodiment of an improved power strip constructed according to the principles of the present invention.
Figure 6B:
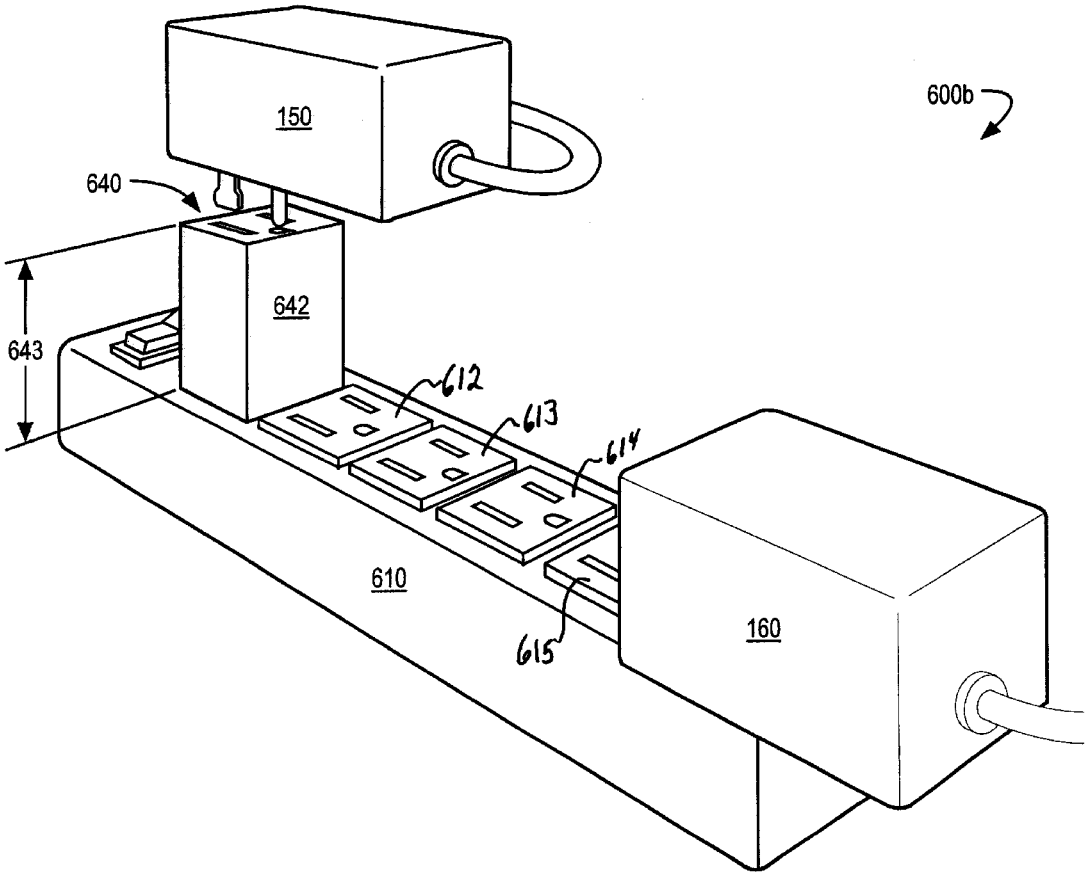

Referring now to FIGS. 6A and 6B, illustrated are two embodiments of an improved power strip constructed according to the principles of the present invention. In FIG. 6A, an improved power strip 600*a* comprises a housing 610, a line cord 620, a cable 630, a female electrical receptacle 640, and a male electrical plug 650. The housing 610 has a plurality of electrical outlets 611–615 electrically coupled to the line cord 620. The line cord 620 extends from the housing 610 and is coupleable to a conventional electrical outlet (not shown) by the male electrical plug 650. In one advantageous embodiment, the housing 610 may be rigid. The cable 630 in one embodiment has multiple insulated conductors 631, 632, 633 and first and second ends 635, 636. The cable 630 may also be termed a multi-conductor electrical cable 630. The first end 635 of the cable 630 is fixedly terminated within the housing 610 and the cable 630 extends from the housing 610. The multi-conductor electrical cable 630 is electrically coupled to contacts 644 (not all shown) within the female electrical receptacle 640.

The line cord 620 is electrically coupled to the multi-conductor electrical cable 630 and, in turn, to the female electrical receptacle 640. In one embodiment, the multi-conductor electrical cable 630 may further include a strain relief structure 634 coupled between the housing 610 and the female electrical receptacle 640. In another embodiment, the strain relief structure 634 substantially surrounds the electrical cable 630. In yet another embodiment, the strain relief structure 636 may be resiliently flexible. In other embodiments, the female electrical receptacle 640 may comprise multiple female electrical outlets 641 (one shown), thereby supplementing the plurality of outlets 611–615. The resilient flexibility allows the cable 630 and strain relief structure 634 to flex from normal a surface 616 of the housing 610.

In an alternative embodiment, the multi-conductor electrical cable 630 is a three-conductor cable of a gauge sufficient to carry 110 volt AC electricity with an ampacity suitable for a conventional duplex outlet circuit, e.g., about 30 amps. In one embodiment, a length 637 of the electrical cable 630 and strain relief structure 634 between the housing 610 and the female electrical receptacle 640 is about two inches. The female electrical receptacle 640 may, in one embodiment, be a two-conductor polarized female electrical receptacle (not shown) and the housing 610 be double insulated as prescribed by current electrical code. One who is skilled in the art is familiar with the principles and employment of polarized connectors and double insulation in their application to electrical appliances. In another embodiment, the female electrical receptacle 640 may be a three-conductor, grounded female electrical receptacle 640, as shown. One who is skilled in the art will readily conceive of other configurations employing multiple female electrical receptacles 640 coupled to the rigid housing 610 to accommodate multiple power converters 160.

Of course, the multi-conductor cable 630, strain relief structure 634, and female electrical receptacle 640 may be constructed in ways analogous to the electrical coupling devices of FIGS. 2A, 2B, 3A and 3B thereby including selected desirable properties, e.g., integral forming, resilient flexibility, etc., of those electrical coupling devices.

In one embodiment, the female electrical receptacle 640 further comprises a boss 645 that is coupled to the female electrical receptacle 640. The boss 645 is configured to couple to a security band 660 disposed about the power converter 160. In a specific aspect of this embodiment, the female electrical receptacle 640 has a body axis 649 and a connector face 648 that is normal the body axis 649. Furthermore, the boss 645 has a concave surface 646 opposite the connector face 648. The concave surface 646 is designed to receive and more securely hold the security band 660 disposed about the power converter 160. In an alternative embodiment, the cable 630 may further comprise an insulation layer 639 surrounding the multiple conductors 631–633. In this embodiment, the strain relief structure 634 substantially surrounds the insulation layer 639.

In the embodiment of FIG. 6B, the female electrical receptacle 640 comprises a rigid body 642 of a sufficient height 643 to permit adjacent outlets 612–615 to be used by conventional male plugs when the female electrical receptacle 640 is coupled to the power converter 150. One who is skilled in the art will readily conceive of other configurations employing alternating, multiple rigid bodies 642 to accommodate multiple power converters 150, 160.

The illustrated embodiments have described conventional, US-standard 110 volt, three-conductor plugs and receptacles. However, one who is skilled in the art will understand that the present invention is envisioned for application to other wiring standards also, e.g., 220/240 volt, two-conductor, European, Australian, Israeli, etc.

Although the present invention has been described in detail, those skilled in the art should understand that they can make various changes, substitutions and alterations herein without departing from the spirit and scope of the invention in its broadest form.

What is claimed is:

1. For use with an electrical device, an electrical coupling device, comprising:

a cable having multiple insulated conductors, said cable having a centerline and first and second ends;

a first electrical connector having a first longitudinal axis coincident with said centerline, said first electrical connector coupled to said first end and coupleable to a power outlet;

a second electrical connector having a second longitudinal axis coincident with said centerline, said second electrical connector coupled to said second end and coupleable to an electrical device; and a strain relief structure substantially surrounding said cable and having a length that extends from said first electrical connector to said second electrical connector and a flexibility along said length, said strain relief structure coupled to said first and second electrical connectors, said flexibility allowing said centerline to resiliently flex such that said second longitudinal axis may deviate in any direction within 360 degrees about said first longitudinal axis, at least about 90 degrees from said first longitudinal axis.

2. The electrical coupling device as recited in claim 1 wherein said flexibility is capable of allowing said centerline to flex such that said second longitudinal axis may deviate at most about 140 degrees from said first longitudinal axis.

3. The electrical coupling device as recited in claim 1 wherein said electrical device is an electrical power converter.

4. The electrical coupling device as recited in claim 1 wherein said first and second electrical connectors and said strain relief structure are integrally formed, said first and second ends being contained within said first and second electrical connectors.

5. The electrical coupling device as recited in claim 1 further comprising an insulation layer surrounding said cable, said strain relief structure substantially surrounding said insulation layer.

6. The electrical coupling device as recited in claim 1 wherein said cable is a multi-conductor electrical cable of a gauge sufficient to carry 110 volts AC electricity between said first and second electrical connectors.

7. The electrical coupling device as recited in claim 1 wherein said first electrical connector is a polarized male electrical plug and said second electrical connector is a polarized female electrical receptacle.

8. The electrical coupling device as recited in claim 1 wherein said length is less than about two inches.

9. The electrical coupling device as recited in claim 1 wherein said first electrical connector is a three-conductor male plug and said second electrical connector is a three-conductor female receptacle.

10. The electrical coupling device as recited in claim 9 wherein said cable comprises first, second, and third electrical conductors, and wherein:

said first electrical conductor is coupleable to a system line conductor of said power outlet;

said second electrical conductor is coupleable to a system common conductor of said power outlet; and said third electrical conductor is coupleable to a system ground of said power outlet.

11. The electrical coupling device as recited in claim 1 further comprising a boss coupled to said second electrical connector, said boss configured to couple to a security band disposed about said electrical device.

12. The electrical coupling device as recited in claim 11 wherein said second electrical connector has a connector face normal said second longitudinal axis and said boss has a concave surface opposite said connector face, said concave surface configured to receive said security band.

13. A power strip, comprising:

a rigid housing having a line cord extending therefrom, said line cord removably coupleable to an electrical power source;

a plurality of electrical outlets coupled to said rigid housing and electrically coupled to said line cord;

a cable having multiple insulated conductors and first and second ends, said first end fixedly terminated within said rigid housing and electrically coupled to said line cord; and a female electrical receptacle electrically coupled to said second end.

14. The power strip as recited in claim 13 further comprising an insulation layer surrounding said cable, said strain relief structure substantially surrounding said insulation layer.

15. The power strip as recited in claim 13 wherein said cable is a multi-conductor electrical cable of a wire gauge sufficient to carry 110 volts AC electricity between said line cord and said female electrical receptacle.

16. The power strip as recited in claim 13 wherein said female electrical receptacle is a polarized female electrical receptacle and said housing is double insulated.

17. The power strip as recited in claim 13 wherein said female electrical receptacle is a three-conductor female electrical receptacle.

18. The power strip as recited in claim 13 wherein said female electrical receptacle has a longitudinal axis and said power strip further comprises a strain relief structure coupled to said rigid housing and said female electrical receptacle, said strain relief structure substantially surrounding said cable and having a length that extends from said rigid housing to said female electrical receptacle and a flexibility along said length, said flexibility capable of allowing said cable to resiliently flex from normal a surface of said rigid housing.

19. The power strip as recited in claim 14 wherein said strain relief structure and said female electrical receptacle are integrally formed, said second end being contained within said female electrical receptacle.

20. The power strip as recited in claim 13 further comprising a boss coupled to said female electrical receptacle, said boss configured to couple to a security band disposed about said electrical device when said electrical device is coupled to said female electrical receptacle.

21. The power strip as recited in claim 20 wherein said female electrical receptacle has a longitudinal axis coincident with said centerline and a connector face normal said longitudinal axis, and said boss has a concave surface opposite said connector face, said concave surface configured to receive said security band.

* * * * *